United States Patent [19]

Collins et al.

[11] 3,970,539

[45] July 20, 1976

[54] END CONNECTOR FOR FILTER PRESS CELL

[75] Inventors: Stephen M. Collins, Trenton; Albert J. Schweickart, Southgate, both of Mich.

[73] Assignee: BASF Wyandotte Corporation, Wyandotte, Mich.

[22] Filed: Dec. 23, 1974

[21] Appl. No.: 535,325

[52] U.S. Cl. ..... 204/254; 204/255; 204/268; 204/279; 204/286

[51] Int. Cl.[2] ..... C25B 11/00; C25B 1/00

[58] Field of Search ..... 204/254, 255, 256, 268, 204/270, 279, 286

[56] References Cited

UNITED STATES PATENTS

| | | | |
|---|---|---|---|
| 3,658,686 | 4/1972 | Schoberle | 204/286 |
| 3,752,756 | 8/1973 | Armstrong et al. | 204/286 X |
| 3,752,757 | 8/1973 | Stephenson et al. | 204/268 X |

FOREIGN PATENTS OR APPLICATIONS

| | | | |
|---|---|---|---|
| 1,054,430 | 4/1959 | Germany | 204/253 |

*Primary Examiner*—T. Tung
*Assistant Examiner*—A. C. Prescott
*Attorney, Agent, or Firm*—Bernhard R. Swick; Arnold S. Weintraub; Robert E. Dunn

[57] ABSTRACT

An end connector for a filter press cell disassociates the mechanical sealing function from the primary electrical connection. The connector includes a boss extension having an aperture formed therein for tightening the connector between the boss and boss extension. The present invention is adaptable for use as an end connector for either the anode or the cathode.

8 Claims, 2 Drawing Figures

END CONNECTOR FOR FILTER PRESS CELL

BACKGROUND OF THE INVENTION

1. Field of the Invention

The present invention pertains to bipolar electrolytic filter press cells. More particularly, the present invention pertains to connectors for bipolar electrolytic filter press cells. Even more particularly, the present invention pertains to end connectors for bipolar electrolytic filter press cells.

2. Prior Art

Conventionally, in a bipolar electrolytic filter press cell, external electrical connections to the cell are made at the ends of the press. One connection is made to an anode on one end. The other connection is made to a cathode at the other end of the press. The connectors must insure a positive liquid or gas seal on the barrier sheet of the last frame. Additionally, the connectors must provide a good electrical connection to the anode or cathode mounted in the last cell.

In U.S. Pat. No. 3,788,966 there is disclosed and claimed a bipolar connector or boss for use in the type of cell under consideration herein. The connector of this patent provides the desired positive electrical connection sought in these types of cells. If an end connector for such cells could be provided which achieves the desired mechanical seal, then, a major advance in the art would be provided. It is to this to which the present invention is directed.

SUMMARY OF THE INVENTION

In accordance with the present invention there is provided an end connector for a bipolar electrolytic filter press cell. The connector hereof provides a positive liquid-gas seal independent of the electrical connection. The connector hereof is adaptable to both the anode end and the cathode end of the filter press cell.

The connector hereof generally comprises a boss extension which is secured to the electrode boss. The boss extension has an aperture therethrough for receiving a tightening rod. A pressure collar is mounted on the boss extension to compress an O-ring seal to form the liquid-gas seal.

For a more complete understanding of the present invention reference is made to the following detailed description and accompanying drawing. In the drawing like reference characters refer to like parts throughout the several views in which:

DESCRIPTION OF THE PREFERRED EMBODIMENTS

Figure 1:
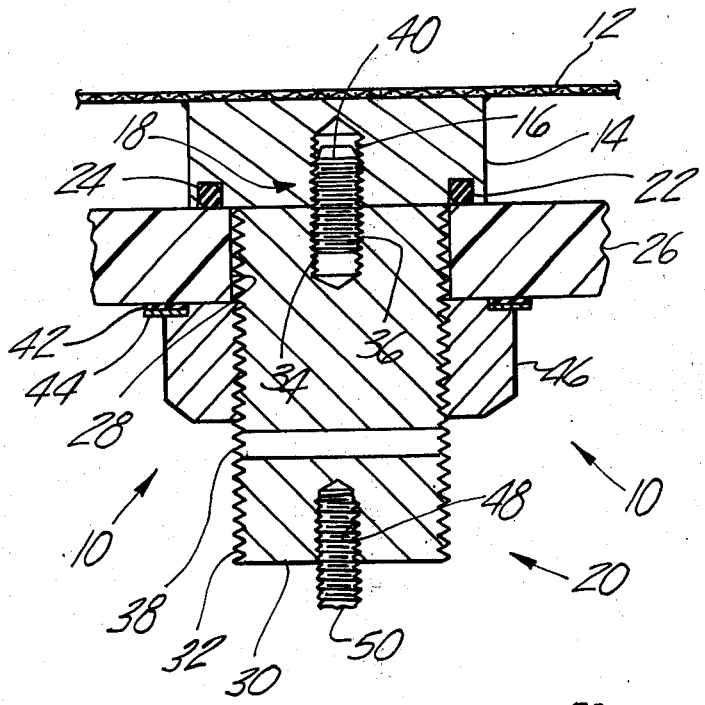
FIG. 1 is a cross-sectional view depicting an anode end connector in accordance with the present invention.

Now with reference to the drawing, and in particular FIG. 1, there is depicted therein an end connector, generally indicated at 10, in accordance with the present invention. The end connector 10 of FIG. 1 is adapted for providing a liquid-gas seal at the anode end of a bipolar electrolytic filter press cell.

As shown in FIG. 1, an anode 12 has mounted thereon a boss or boss member 14, in a conventional manner. The boss 14 includes a central partial bore 16. The bore 16 is internally threaded to receive means 18 for securing a boss extension or boss extension member 20 to the boss 14 in a manner subsequently described.

The boss 14 has a circumferential recess 22 formed therein on the end thereof remote from the anode 12. An O-ring seal 24 is disposed within the recess 22.

As is known to those skilled in the art, separating adjacent cells and interposed between adjacent anodes and cathodes is a central plastic web or barrier 26. The remote end of the boss 14 abuts against the barrier 26 associated with the last cell unit within the module at each end, as shown. The barrier 26 is provided with an aperture 28 through which the boss extension is insertable.

The boss extension 20 comprises an elongated member 30 and having an external thread 32. The member 30, also, includes a partial bore 34 formed at one end thereof. The bore 34 is adapted to register with the bore 16 formed in the boss 14. The bore 34 has an internal thread 36 formed therewithin.

A transverse aperture 38 is formed through the member 30, as shown. The aperture 38 receives a tightening rod (not shown) therethrough for tightening the connection between the boss and the boss extension.

In connecting the boss 14 and boss extension 20, a threaded member, such as a set screw 40 is threadably received within the partial bores 16, 36, respectively. By threadably securing both the boss and the boss extension to the screw 40 interconnection therebetween, through the central barrier 26, is achieved with the screw bottoming out in bore 36 with the screw bottoming out in bore 36.

Still referring to FIG. 1, a washer 42 and a gasket 44 are mounted on the boss extension 20, as shown. Threadably mounted on the member 30 is a pressure collar 46. The pressure exerted by the collar provides the liquid-gas seal.

In making an electrical connection at the anode end, the free end of the member 30 is provided with a partial bore 48 which receives a bolt 50. The bolt 50 electrically receives a cable connector or bus bar (not shown).

In assembling the anode end connector an electrical conductivity paste is applied to the interface of the boss and boss extender.

With the tightening of the pressure collar, the O-ring seal is compressed to provide the liquid-gas seal independent of the electrical connection.

The gasket and washer provide a back-up seal and an even distribution of the compressive forces exerted by the pressure collar.

The boss extension and collar can be formed of any suitable material which is electrically conductive and corrosion resistant. A preferred material is mild steel.

Figure 2:
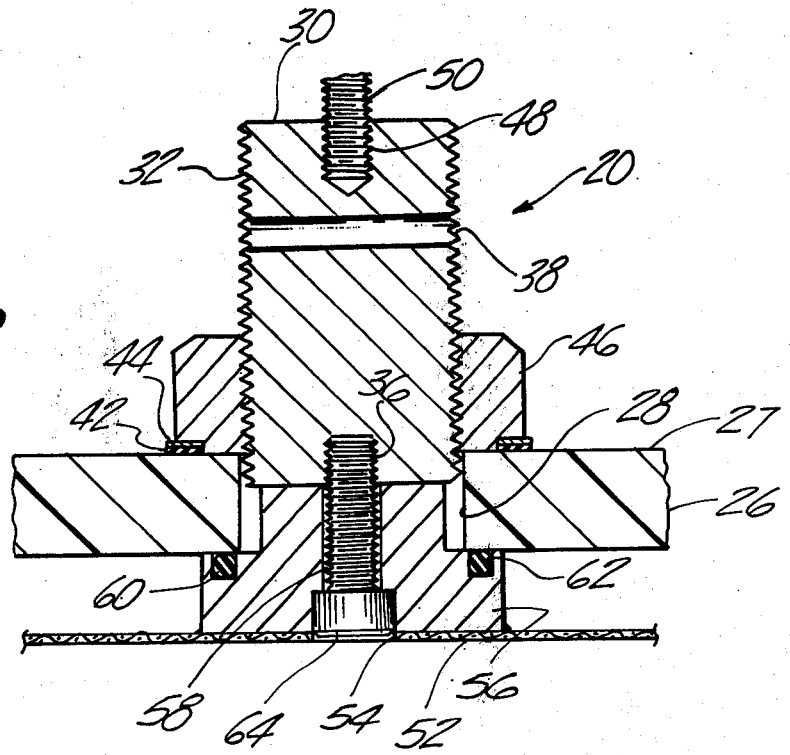
FIG. 2 is a cross-sectional view depicting a cathode end connector in accordance with the present invention.

Referring now to FIG. 2, there is depicted therein the modification of the present invention which is an end connector for the cathode end of the cell.

In accordance herewith a cathode screen 52 has an opening 54 provided therein. A boss 56 is secured to the cathode in a conventional manner. The boss 56 has an internal throughbore 58 which is in registry with the opening 54. The boss 56 may partially extend into the opening 28 of the barrier 26 as shown, or may seat flush with the surface 27 of the central barrier 26. The boss, also, includes a recess 60 in which is disposed an O-ring seal 62 which engages the surface of the barrier 26, as shown.

Abutting the surface of the boss remote from the cathode screen is a first end surface of the boss extension 20. An internally threaded partial bore 36 is formed in the extension 20 and is in registry with the bore 58 formed through the boss 56. The assembly of the boss extension including the pressure collar 46 is the same as described hereinabove. However, in lieu of the set screws, the interconnection between the boss and the boss extension is achieved through a threaded fastener such as bolt 64. The bolt is inserted through the opening 54, through the bore 58 and is threadably secured in the partial bore 36.

The electrical connection at the cathode end is achieved in the manner heretofore described.

Again, it is apparent that the cathode end connector provides a positive liquid-gas seal independent of the electrical connection.

Moreover, and as hereinbefore noted, the present end connector is adapted to mate with the electrical connector described in U.S. Pat. No. 3,788,966, the disclosure of which is hereby incorporated by reference.

Having, thus, described the invention, what is claimed is:

1. In a bipolar electrolytic filter press cell of the type having an anode and a cathode, each electrode having a boss member associated therewith and a central web interposed between the anode and cathode, an improved end connector therefor, comprising:

a. a boss extension member which matingly engages the surface of the boss member remote from an associated electrode, b. a pressure collar mounted on the boss extension member, and c. means interconnecting the boss member and the boss extension member, such that the connector defines a liquid-gas seal independent of an electrical connection.

2. The end connector of claim 1 wherein the boss extension member includes a partial bore having an internal thread, the boss includes a partial bore having an internal thread, the partial bores being in registry, and the interconnecting means comprises a threaded fastener disposed in the partial bores.

3. The end connector of claim 2 wherein the boss is associated with the anode.

4. The end connector of claim 1 wherein the boss extension member includes means for electrically connecting the electrode thereto, the means being provided at the end of the boss opposite the boss engaging end.

5. The end connector of claim 1 wherein the boss extension member has an internally threaded partial bore formed therein, the boss has an internal throughbore formed therethrough and being in registry with the partial bore and the interconnecting means comprises a threaded fastener extending through the throughbore and into the partial bore.

6. The end connector of claim 5 wherein the boss member is associated with the cathode, the threaded fastener extending through an opening provided in the cathode.

7. The end connector of claim 1 wherein the pressure collar is threadably mounted on the boss extension member.

8. The end connector of claim 1 wherein the boss extension member extends at least partially through an aperture formed in the web associated with the last cell of the module.

* * * * *